US012083570B2

(12) United States Patent
Maeda et al.

(10) Patent No.: US 12,083,570 B2
(45) Date of Patent: Sep. 10, 2024

(54) EXTRUDED MATERIAL AND METHOD FOR PRODUCING THE SAME

(71) Applicant: KOBE STEEL, LTD., Hyogo (JP)

(72) Inventors: Yasuhiro Maeda, Kobe (JP); Toru Hashimura, Kobe (JP); Taiki Yamakawa, Shimonoseki (JP)

(73) Assignee: KOBE STEEL, LTD., Hyogo (JP)

( * ) Notice: Subject to any disclaimer, the term of this patent is extended or adjusted under 35 U.S.C. 154(b) by 40 days.

(21) Appl. No.: 18/189,093

(22) Filed: Mar. 23, 2023

(65) Prior Publication Data

US 2023/0405658 A1 Dec. 21, 2023

(30) Foreign Application Priority Data

May 26, 2022 (JP) ..... 2022-086256

(51) Int. Cl.
*B21C 26/00* (2006.01)
*B21C 23/08* (2006.01)

(52) U.S. Cl.
CPC ..... *B21C 23/085* (2013.01); *B21C 26/00* (2013.01)

(58) Field of Classification Search
None
See application file for complete search history.

(56) References Cited

U.S. PATENT DOCUMENTS 2,929,408 A * 3/1960 Smith ..... F28F 13/06 138/116
8,978,711 B2 * 3/2015 Satou ..... F16L 41/084 138/117
10,914,076 B1 * 2/2021 Santini ..... B21C 23/085

FOREIGN PATENT DOCUMENTS

JP H11-180349 A 7/1999
JP 2005-199840 A 7/2005

* cited by examiner

*Primary Examiner* — Daniel J. Schleis
(74) *Attorney, Agent, or Firm* — Studebaker & Brackett PC

(57) ABSTRACT

An extruded material includes a peripheral wall having a closed loop-shaped cross-section and defining a hollow, and a middle rib connected to an inner peripheral surface of the peripheral wall and dividing the hollow. The extruded material is provided with a corrected portion set at a predetermined portion in a longitudinal direction and subjected to correction processing, and an uncorrected portion not subjected to the correction processing. The peripheral wall is expanded outward with respect to an original shape of the uncorrected portion in the corrected portion. While the middle rib is curved with respect to an imaginary straight line connecting connecting portions connected with the peripheral wall at both end portions of the middle rib in the uncorrected portion, the middle rib has a smaller degree of curvature than the original shape of the uncorrected portion in the corrected portion.

8 Claims, 12 Drawing Sheets

EXTRUDED MATERIAL AND METHOD FOR PRODUCING THE SAME

CROSS-REFERENCE TO RELATED APPLICATION

This application claims the benefit of foreign priority to Japanese Patent Application No. 2022-086256, filed on May 26, 2022, which is incorporated by reference in its entirety.

BACKGROUND OF THE INVENTION

Field of the Invention

The present invention relates to an extruded material and a method for producing the same.

Description of Related Art

The extruded material can easily obtain a smooth surface and a complex cross-section or a hollow shape, and has been utilized in a variety of applications. For example, as disclosed in Japanese Patent Application Laid-Open Publications No. 11-180349 and No. 2005-199840, an aluminum alloy extruded material is widely applied to a vehicle frame because it contributes to weight reduction.

When the aluminum extruded material is applied to the vehicle frame, first, the extruded material is molded by compressing a material with an extrusion molding machine. Subsequently, the extruded material is subjected to required metal processing such as bending or drilling to produce a member constituting the vehicle frame. The member of the vehicle frame is provided with one or more mating surfaces for assembly with other members. The vehicle frame is formed by joining members by welding or fastening.

SUMMARY OF THE INVENTION

Dimensional accuracy required for the mating surfaces is higher than that of other portions in the same member, and in some cases higher than the dimensional accuracy generally achievable in extruded materials. Therefore, it is difficult to satisfy the dimensional accuracy of the mating surfaces when producing the member from the extruded material. Such a situation may similarly occur when the extruded material is applied to parts other than the vehicle frame.

An object of the present invention is to provide an extruded material capable of improving a dimensional error of a member produced from the extruded material.

A first aspect of the present invention provides a method for producing an extruded material, including: extruding a metal material to obtain the extruded material; and performing correction of the extruded material, in which the extruded material includes a peripheral wall having a closed loop-shaped cross-section and defining a hollow, and a middle rib connected to an inner peripheral surface of the peripheral wall and dividing the hollow, in an original shape of the extruded material before the correction, the middle rib has a cross-section curved with respect to an imaginary straight line connecting connecting portions connected with the peripheral wall, and the correction includes: disposing a mold so as to face an outer peripheral surface of the peripheral wall at a predetermined portion in a longitudinal direction of the extruded material; and expanding the peripheral wall outward at the predetermined portion, pressing the outer peripheral surface of the peripheral wall against an inner surface of the mold while reducing a degree of curvature of the middle rib with respect to the original shape, and transferring an inner surface shape of the mold to the outer surface of the peripheral wall.

According to the above, the extruded material is partially expanded at the predetermined portion, and the inner surface shape of the mold is transferred to the outer surface of the peripheral wall. The dimensional accuracy of the extruded material can be increased to the same degree as that of the mold in the predetermined portion. Note that the middle rib of the extruded material is curved in the original shape before the correction. Therefore, when the peripheral wall is expanded outward at the predetermined portion, a linear distance between both end portions of the middle rib increases so that the degree of curvature of the middle rib decreases. Therefore, the middle rib does not inhibit the peripheral wall from being expanded outward.

Expanding the peripheral wall outward may include: disposing rubber at the predetermined portion in the hollow; and compressing the rubber in the longitudinal direction to bulge the rubber in a direction intersecting the longitudinal direction, and expanding the peripheral wall outward by the bulged rubber.

Thus, the extruded material can be easily corrected by application of so-called rubber bulge forming.

When the rubber is disposed, a core may be disposed adjacent to the rubber in the longitudinal direction in the hollow, and when the rubber is compressed, the rubber may be pressed by a pusher from a side opposite to the core, and be compressed by the pusher and the core.

Thus, the correction of the extruded material by application of so-called rubber bulge forming is achieved.

A plurality of the predetermined portions may be set apart from each other in the longitudinal direction, when the rubber is disposed, a plurality of sets of the rubbers and cores may be respectively arranged at the plurality of predetermined portions, and when the rubber is compressed, the plurality of sets of the rubbers may be compressed all together by a pressing force of the single pusher.

Thus, when there are a plurality of portions for which the dimensional accuracy is desired to be improved, production steps and production time can be reduced as compared with a case where peripheral walls are expanded one by one for each portion. In addition, dimensional accuracy between a plurality of corrected portions can be secured in a single member.

The cross-section of the peripheral wall may be rectangular, and the peripheral wall may have a pair of long side walls forming long sides of the rectangular cross-section and a pair of short side walls forming short sides of the rectangular cross-section, and the single middle rib may connect inner surfaces of the pair of long side walls and divide the hollow into a first chamber and a second chamber extending in the longitudinal direction.

Thus, the dimensional accuracy of the extruded material applicable to a structural member such as a vehicle frame can be improved.

In the original shape before the correction, the middle rib may have two protrusions of a first protrusion protruding to the first chamber and a second protrusion protruding to the second chamber with respect to the imaginary straight line.

Thus, the peripheral wall is smoothly expanded, and the extruded material is properly corrected.

In the original shape before the correction, the middle rib may have a single protrusion protruding to the first chamber with respect to the imaginary straight line, and the first chamber may have a cross-sectional area larger than that of the second chamber.

Thus, the peripheral wall is smoothly expanded, and the extruded material is properly corrected.

A second aspect of the present invention provides an extruded material including: a peripheral wall having a closed loop-shaped cross-section and defining a hollow; a middle rib connected to an inner peripheral surface of the peripheral wall and dividing the hollow; a corrected portion set at a predetermined portion in a longitudinal direction and subjected to correction processing; and an uncorrected portion not subjected to the correction processing, in which the peripheral wall is expanded outward with respect to an original shape of the uncorrected portion in the corrected portion, and the middle rib is curved with respect to an imaginary straight line connecting connecting portions connected with the peripheral wall at both end portions of the middle rib in the uncorrected portion, and has a smaller degree of curvature than the original shape of the uncorrected portion in the corrected portion.

According to the present invention, it is possible to provide the extruded material capable of improving the dimensional error of the member produced from the extruded material.

DETAILED DESCRIPTION OF THE PREFERRED EMBODIMENT

Figure 1:
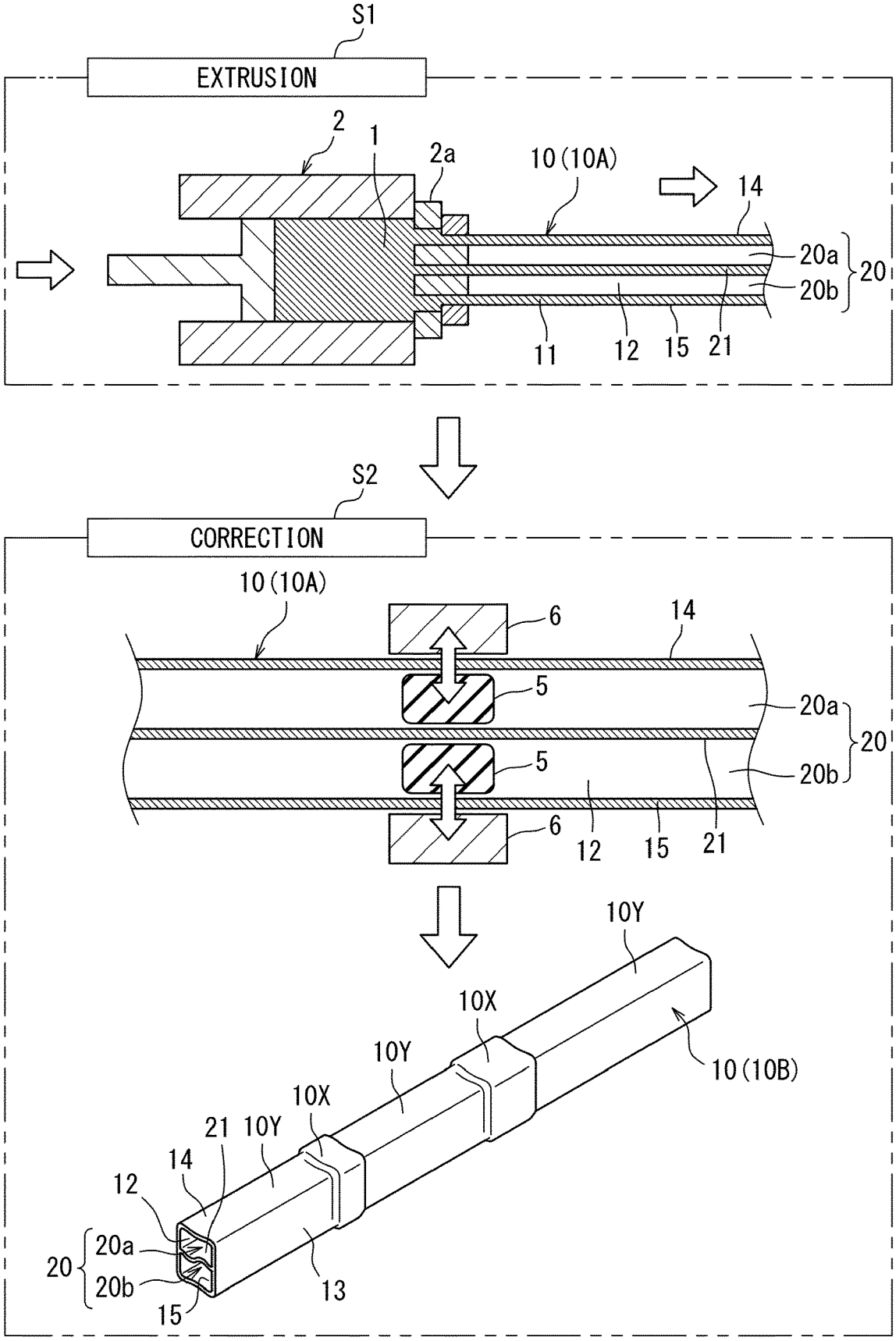
FIG. 1 is a schematic view of a method for producing an extruded material according to a first embodiment of the present invention.

Hereinafter, embodiments of the present invention will be described with reference to the accompanying drawings. Note that the same or corresponding elements are denoted by the same reference numerals throughout the drawings, and overlapping of detailed description will be omitted.

First Embodiment

An outline of a method for producing an extruded material 10 will be described with reference to FIG. 1. First, a metal material 1 is extruded to obtain the extruded material 10 (10A) (step S1). In extrusion molding, after the material 1 is compressed by an extrusion molding machine 2 and extruded from a die 2*a*, necessary processing such as cooling, take-up, and cutting is performed.

The material 1 is not particularly limited. When the extruded material 10 is applied to a structural component such as a member of a vehicle frame, a light alloy such as an aluminum alloy and a magnesium alloy is a preferable example of the material 1 because it contributes to both weight reduction and high rigidity. Hereinafter, as a mere example, a case where the material 1 is an aluminum alloy will be described. Since the extruded material 10 of the aluminum alloy is molded hot, strain and torsion are likely to occur, and it is difficult to obtain high dimensional accuracy.

Next, the extruded material 10 (10A) is subjected to correction processing (step S2). The correction processing is locally performed on one or more predetermined portions. The extruded material 10 (10B) after the correction includes a corrected portion 10X subjected to the correction processing and an uncorrected portion 10Y not subjected to the correction processing. The corrected portion 10X corresponds to the predetermined portion. When the plurality of predetermined portions are set, a plurality of the corrected portions 10X are provided apart from each other in a longitudinal direction of the extruded material 10. The uncorrected portion 10Y is a portion that maintains an original shape of the extruded material 10A before the correction even after the correction. In the present embodiment, the extruded material 10 has a hollow 20, and rubber bulge forming is applied to the correction processing. Therefore, the corrected portion 10X is slightly expanded outward over an entire circumference with respect to the uncorrected portion 10Y.

The extruded material 10A immediately after being taken out of the extrusion molding machine 2 is an intermediate product before the correction. The extruded material 10B after the correction is a product used for producing the member of the vehicle frame. In producing the member, the extruded material 10 is subjected to required processing such as bending and punching so as to satisfy design requirements determined for each member. The member is provided with one or more mating surfaces for assembly with other parts. The dimensional accuracy of the mating surfaces may be set higher than that of other portions in the same part.

The corrected portion 10X corresponds to a portion where the mating surface is to be provided when the member is produced from the extruded material 10. In the corrected portion 10X, a dimensional error caused by the extrusion molding is locally eliminated or reduced. Therefore, at a stage of producing the member from the extruded material 10, the dimensional error of the mating surface can be easily kept within a range of required accuracy. In the uncorrected portion 10Y, the dimensional error generated at the time of extrusion molding remains, but the dimensional accuracy required at a portion other than the mating surface is relatively low. Since it is not always necessary to subject the entire extruded material 10 to the correction processing, production cost of the extruded material 10 can be reduced to a low level.

Figure 2:
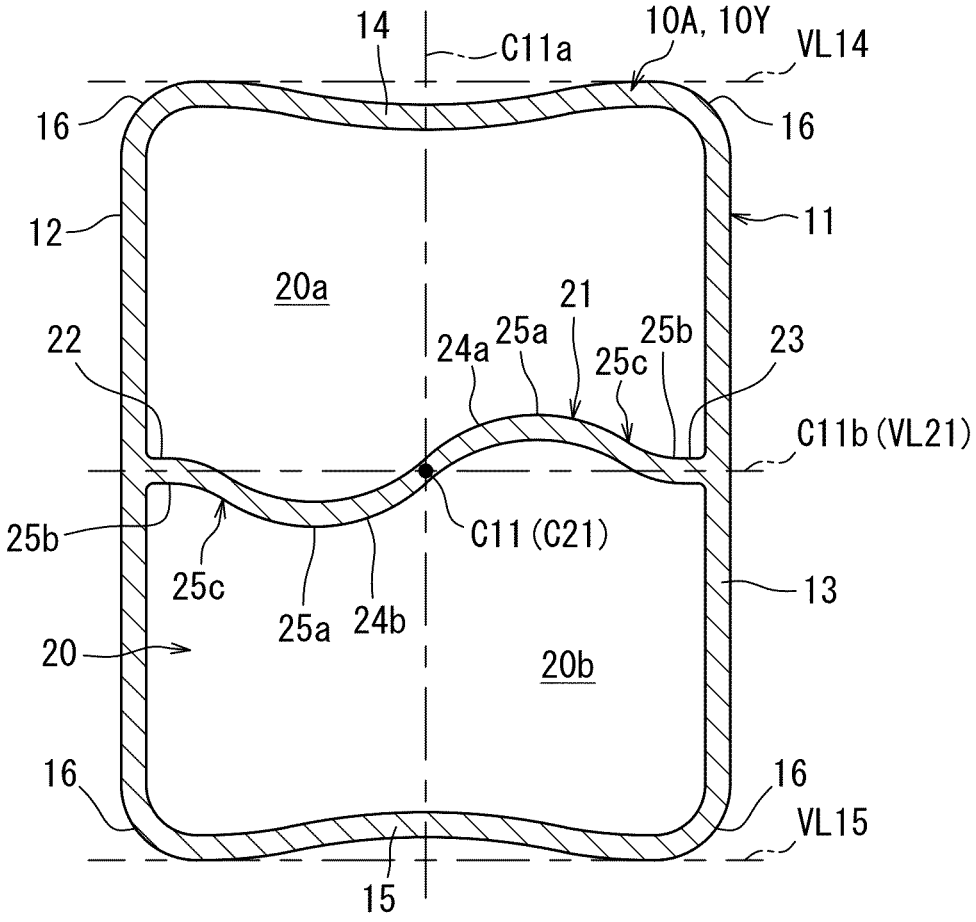
FIG. 2 is a cross-sectional view illustrating an original shape of the extruded material before correction (and an uncorrected portion after the correction)

Hereinafter, the extruded material 10 and the correction processing thereof will be specifically described. Referring to FIG. 2, an extruded material 10A before the correction has a peripheral wall 11 having a substantially rectangular cross-section and a middle rib 21 dividing a hollow 20 surrounded by the peripheral wall 11. The peripheral wall 11 and the middle rib 21 extend in the longitudinal direction of the extruded material 10A. The peripheral wall 11 has a pair of long side walls 12 and 13 forming long sides of the rectangular cross section and a pair of short side walls 14 and 15 forming short sides of the rectangular cross-section, and the long side walls 12 and 13 and the short side walls 14 and 15 are continuous via curved corner portions 16. A cross-sectional shape of the peripheral wall 11 is uniform in the longitudinal direction. Hereinafter, in a plane perpendicular to the longitudinal direction, an extending direction of the long side walls 12 and 13 is referred to as a "long side direction", and an extending direction of the short side walls 14 and 15 perpendicular to the long side direction is referred to as a "short side direction".

In the present embodiment, as an example, the middle rib 21 is single. The middle rib 21 is connected to inner peripheral surfaces of the pair of long side walls 12 and 13 at both end portions of the middle rib, and extends in the hollow 20 between the pair of long side walls 12 and 13 in the short side direction. Thus, the hollow 20 is divided into a first chamber 20*a* and a second chamber 20*b* extending in the longitudinal direction.

The first chamber 20*a* is defined by the inner peripheral surface of the short side wall 14, and the second chamber 20*b* is defined by the inner peripheral surface of the short side wall 15. Hereinafter, connecting portions between end portions of the middle rib 21 and the inner peripheral surfaces of the long side walls 12 and 13 is referred to as "connecting portions 22 and 23". The connecting portion 22 is formed on the inner peripheral surface of the long side wall 12, and the connecting portion 23 is formed on the inner peripheral surface of the long side wall 13.

The middle rib 21 does not connect a pair of connecting portions 22 and 23 or the pair of long side walls 12 and 13 at a shortest distance. The middle rib 21 has a cross-section curved with respect to an imaginary straight line VL21 connecting the connecting portions 22 and 23. The connecting portions 22 and 23 are positioned at positions facing each other in the short side direction, in other words, at positions corresponding to each other in the long side direction, and the imaginary straight line VL21 extends in the short side direction.

The middle rib 21 has two protrusions of a first protrusion 24*a* protruding to the first chamber 20*a* and a second protrusion 24*b* protruding to the second chamber 20*b* with respect to the imaginary straight line VL21. The first protrusion 24*a* and the second protrusion 24*b* are continuous in the short side direction from the connecting portion 23 toward the connecting portion 22 in this order. The first protrusion 24*a* and the second protrusion 24*b* have the same length in the short side direction (extending direction of the imaginary straight line VL21) and the same protrusion length from the imaginary straight line VL21. The middle rib 21 is point-symmetrical about an intersection point C21 between the imaginary straight line VL21 and a short-side direction center line C11*a* of the peripheral wall 11.

In the present embodiment, the connecting portions 22 and 23 are connected to midpoint portions of the long side walls 12 and 13 in the long side direction. Therefore, the imaginary straight line VL21 overlaps a long-side direction center line C11*b* of the peripheral wall 11, and the point C21 overlaps a center C11 of the peripheral wall 11. The peripheral wall 11 is line-symmetric with respect to both the long-side direction center line C11*b* and the short-side direction center line C11*a*, and is point-symmetric about the center C11. Therefore, a cross-sectional area of the first chamber 20*a* is equal to that of the second chamber 20*b*.

The first protrusion 24*a* is formed in a U shape protruding toward the first chamber 20*a* between the connecting portion 23 and the point C21. The second protrusion 24*b* is formed in a U shape protruding toward the second chamber 20*b* between the point C21 and the connecting portion 22. Vertices of the first protrusion 24*a* and the second protrusion 24*b* are located closer to the point C21 than respective intermediate points between the point C21 and the inner peripheral surfaces of the long side walls 12 and 13.

In this regard, the first protrusion 24*a* protrudes toward the first chamber 20*a* as a whole, and includes a first arcuate portion 25*a* that curves protruding toward the first chamber 20*a* and a second arcuate portion 25*b* that is continuous with the first arcuate portion 25*a* and curves protruding toward the second chamber 20*b*. An inflection portion 25*c* between the first arcuate portion 25*a* and the second arcuate portion 25*b* is close to the connecting portion 23, and a vertex of the second arcuate portion 25*b* is positioned at the connecting portion 23. Thus, the middle rib 21 can be connected in a state perpendicular to the long side wall 13 at the connecting portion 23 while the first protrusion 24*a* is curved gently and in the short side direction in a wide range and protruded to the first chamber 20*a*. The point-symmetric second protrusion 24*b* is similar to this.

Each of the long side walls 12 and 13 has a linear cross-section, and connects end portions of the pair of short side walls 14 and 15 at a shortest distance. In contrast, the short side walls 14 and 15 do not connect end portions of the pair of long side walls 12 and 13 at the shortest distance. The short side walls 14 and 15 are recessed inward (toward the hollow 20) with respect to imaginary straight lines VL14 and VL15 connecting the corner portions 16.

Such an original shape of the extruded material 10A before the correction (and a shape of the uncorrected portion 10Y of the extruded material 10B after the correction) is easily formed according to a shape of the die 2*a* (see FIG. 1) of the extrusion molding machine 2.

Figure 4:
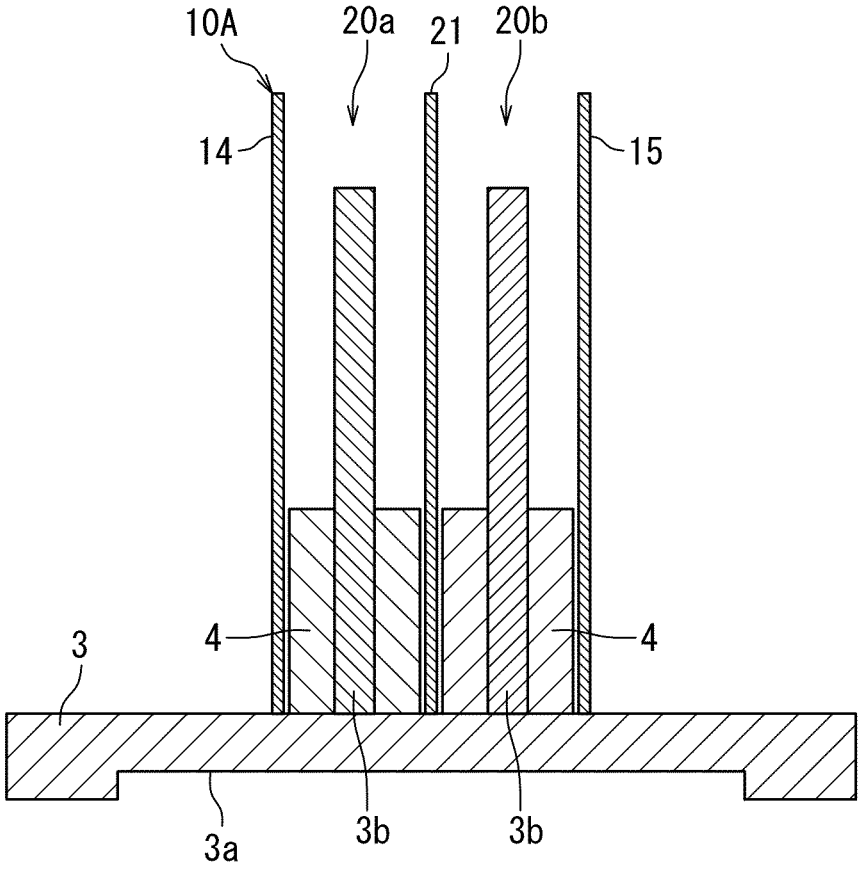
FIG. 4 is an explanatory view of a method for producing the extruded material.

Next, the correction processing will be described with reference to FIGS. 4 to 7. Here, an example of a procedure of the correction processing is described, and an arrangement procedure of a jig 3 and the extruded material 10 can be appropriately changed. As illustrated in FIG. 4, first, the extruded material 10A is provided on the jig 3. The jig 3 includes a base 3*a* fixed to a ground and two guide shafts 3*b* extending perpendicularly from a surface of the base 3*a*. In the illustrated example, the base 3*a* is provided horizontally and the guide shafts 3*b* extend vertically, but orientation of the jig 3 can be changed as appropriate.

Next, the extruded material 10A is supported on the surface of the base 3*a* such that the two guide shafts 3*b* are respectively inserted into the first chamber 20*a* and the second chamber 20*b*. For example, an end surface of the extruded material 10A is placed on the base 3*a*, and the extruded material 10A is supported by the jig 3 in a vertically extending posture.

Next, two cores 4 are respectively arranged inside the first chamber 20*a* and the second chamber 20*b*. The cores 4 are fixedly provided to the jig 3. As an example, each core 4 has an insertion hole through which the corresponding guide shaft 3*b* is inserted, and one end surface thereof is placed on a peripheral portion of the guide shaft 3*b* in the surface of the base 3*a*. The other end surface of the core 4 is positioned at a limit point on one side in the longitudinal direction of the predetermined portion to be subjected to the correction processing. However, the core 4 may not be disposed after the extruded material 10A is provided on the base 3*a*. The core 4 may be fixed to the base 3*a* in advance.

Figure 5:
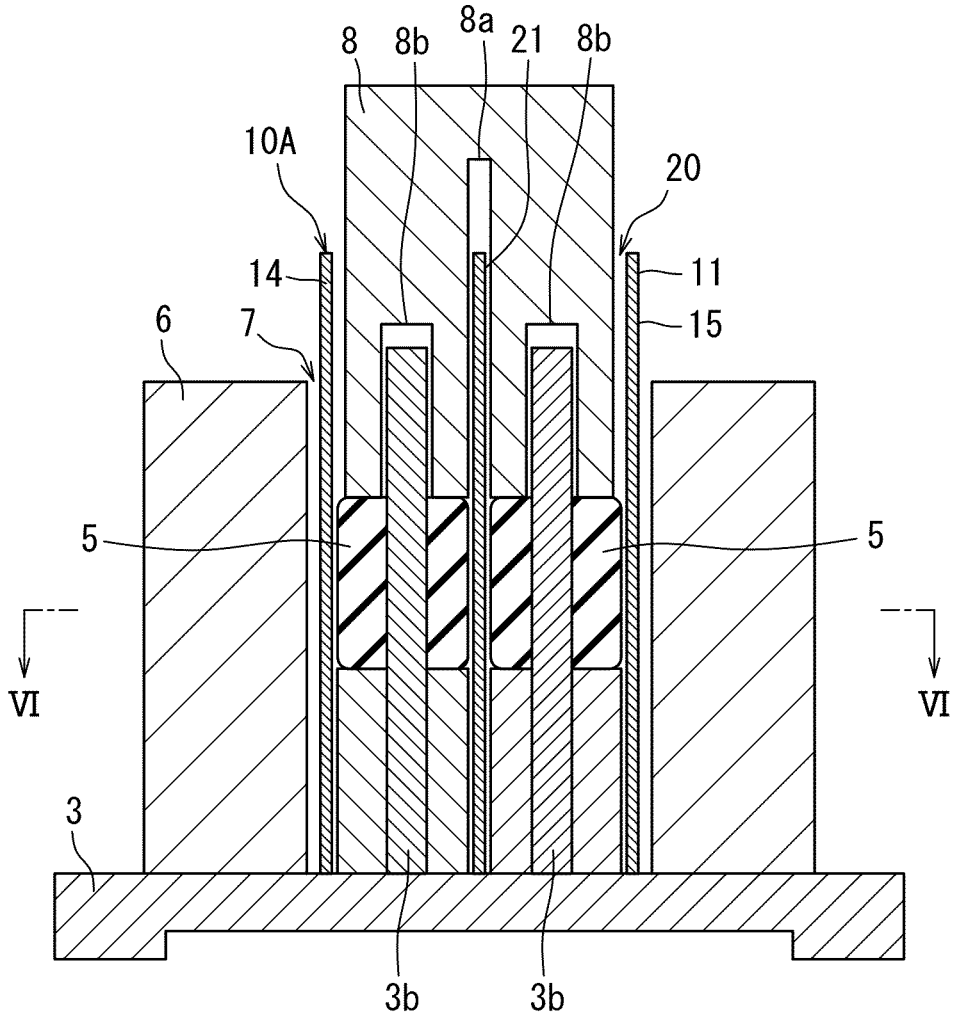
FIG. 5 is an explanatory view of the method for producing the extruded material.

Next, as illustrated in FIG. 5, two rubbers 5 are respectively arranged inside the first chamber 20*a* and the second chamber 20*b*. The guide shaft 3*b* is inserted into the rubber 5. One end surface of the rubber 5 is supported by the other end surface of the core 4, and the core 4 is adjacent to the rubber 5 in the longitudinal direction in the hollow 20.

Figure 6:
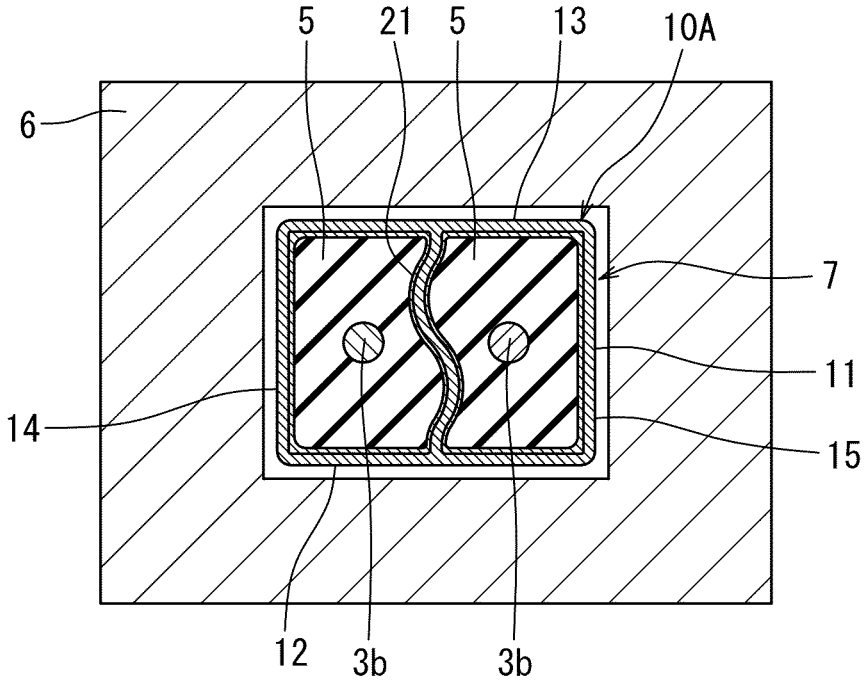
FIG. 6 is a cross-sectional view taken along a line VI-VI of FIG. 5.

Next, as illustrated in FIGS. 5 and 6, a mold 6 is disposed to face an outer peripheral surface of the peripheral wall 11 over the entire circumference while surrounding the peripheral wall 11. The mold 6 is formed in a divided structure in order to facilitate the extruded material 10B after the correction. The mold 6 may not be disposed after the extruded material 10A is provided on the base 3*a*. A fixed mold of the mold 6 having a divided structure may be attached to the base 3*a* in advance, and a movable mold may be supported movably with respect to the base 3*a* in advance. In the present example, an inner surface of the mold 6 has a rectangular cross-section. Before the correction, the inner surface of the mold 6 is positioned outside the peripheral wall 11 with a clearance 7 (for example, about 1 mm) from the outer peripheral surface of the peripheral wall 11.

Next, as illustrated in FIG. 5, a pusher 8 is disposed in the hollow 20. The pusher 8 has a slit 8*a* and two guide holes 8*b* that open at one end surface and extend in the longitudinal direction. The pusher 8 is disposed in the hollow 20 with one end surface facing the rubber 5 such that the middle rib 21 is received in the slit 8*a* and the two guide shafts 3*b* are respectively inserted into the two guide holes 8*b*. The pusher 8 is positioned on a side opposite to the core 4 as viewed from the rubber 5, and one end surface thereof is in contact with the other end surface of the rubber 5. In this contact state with the rubber 5, a clearance is formed between a tip surface of the guide shaft 3*b* and a bottom surface of the guide hole 8*b*.

Figure 7:
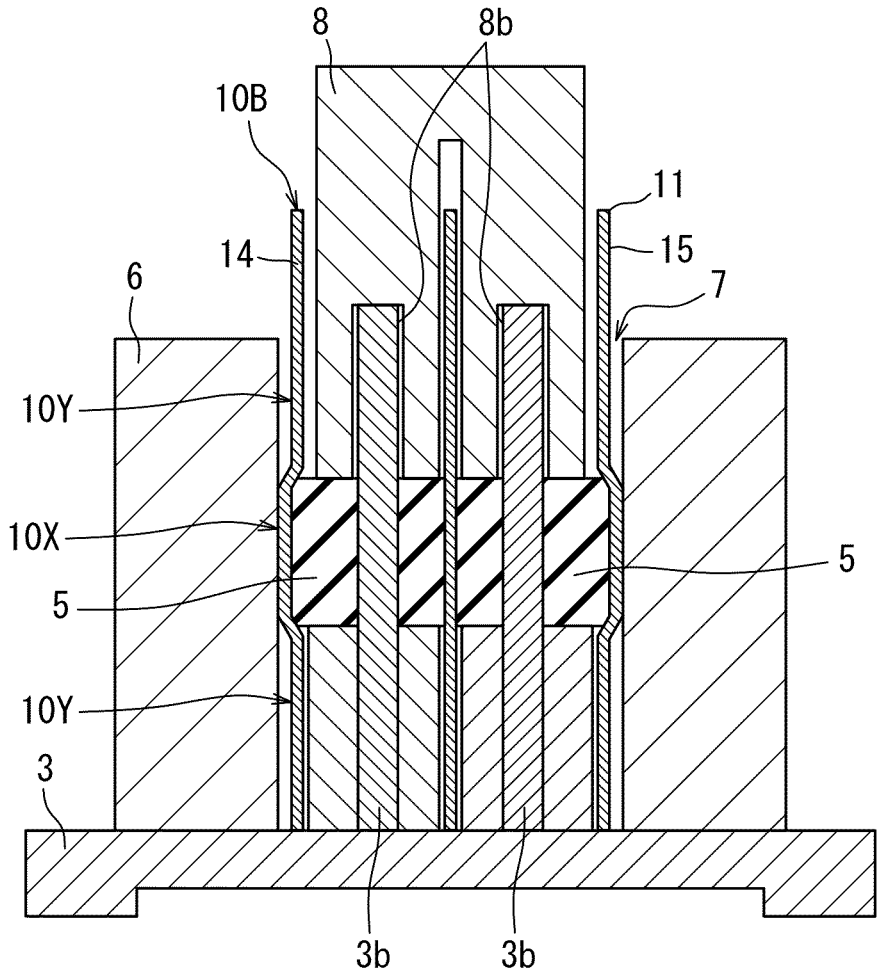
FIG. 7 is an explanatory view of the method for producing the extruded material.

Next, as illustrated in FIG. 7, the rubber 5 is pressed by the pusher 8 from the side opposite to the core 4. The core 4 and the guide shafts 3*b* are fixed to the jig 3 side. Therefore, the rubber 5 is compressed by the core 4 and the pusher 8. Displacement of the pusher 8 is restricted by the bottom surface of the guide hole 8*b* coming into contact with the tip surface of the guide shaft 3*b*. That is, the rubber 5 is compressed in the longitudinal direction by the clearance in the guide hole 8*b*.

The rubber 5 bulges in a radial direction (a direction perpendicular to the longitudinal direction) as it is compressed. The inner peripheral surface of the peripheral wall 11 is pressed outward by the bulged rubber 5, and the peripheral wall 11 is pushed and expanded outward. At a portion (a predetermined portion) where the rubber 5 is disposed, the clearance 7 between the peripheral wall 11 and the mold 6 is eliminated, and the outer peripheral surface of the peripheral wall 11 is pressed against the inner surface of the mold 6. Outward expansion of the peripheral wall 11 is restricted by the mold 6, and an inner surface shape of the mold 6 is transferred to the outer peripheral surface of the peripheral wall 11. Thus, the correction processing for one predetermined portion is completed.

Figure 3:
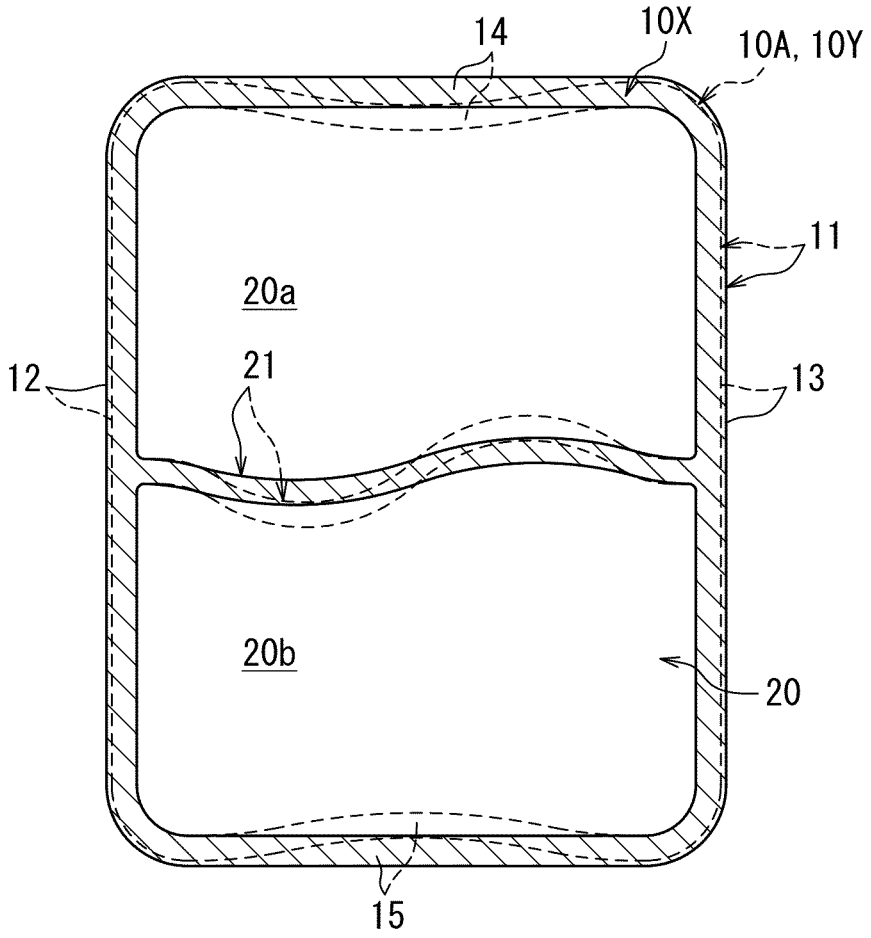
FIG. 3 is a cross-sectional view illustrating a corrected portion.

In FIG. 3, a cross-section of the corrected portion 10X is indicated by a solid line, and a cross-section of the uncorrected portion 10Y (that is, the extruded material 10A before the correction) is indicated by a broken line. As a result of the correction processing using the rubber bulge forming, the peripheral wall 11 of the corrected portion 10X is positioned slightly outside that of the uncorrected portion 10Y (see also FIG. 1).

In the predetermined portion subjected to the correction processing, when the peripheral wall 11 is expanded outward, a degree of curvature of the middle rib 21 is reduced with respect to the original shape. Therefore, in the corrected portion 10X, the degree of curvature of the middle rib 21 is smaller than that of the original shape maintained in the uncorrected portion 10Y, and the middle rib 21 extends more linearly in the hollow 20. When the peripheral wall 11 (the pair of long side walls 12 and 13 to which the middle rib 21 is connected) is expanded outward in the short side direction, the middle rib 21 is deformed to eliminate protrusions of the protrusions 24*a* and 24*b*.

Thus, the middle rib 21 can be suppressed from stiffening between the long side walls 12 and 13, and the peripheral wall 11 can be smoothly expanded outward in the extruded material 10 having the middle rib 21. In particular, among the long side walls 12 and 13, peripheral portions of the connecting portions 22 and 23 can expand outward without being obstructed by the middle rib 21 similarly to other portions, so that flatness of outer surfaces of the long side walls 12 and 13 can be secured.

A curved shape of the middle rib 21 is set such that the connecting portions 22 and 23 are connected to the long side walls 12 and 13 in a state of being substantially perpendicular thereto. Therefore, it is possible to avoid occurrence of excessive stress concentration in the connecting portions 22 and 23.

Since the short side walls 14 and 15 are also recessed, the short side walls 14 and 15 are deformed so as to eliminate recesses when the peripheral wall 11 expands outward, similarly to an effect of the middle rib 21. Peripheral portion of the corner portions 16 of the long side walls 12 and 13 can expand outward without being obstructed by the short side walls 14 and 15 similarly to other portions, so that the flatness of the outer surfaces of the long side walls 12 and 13 can be secured.

Second Embodiment

Figure 8:
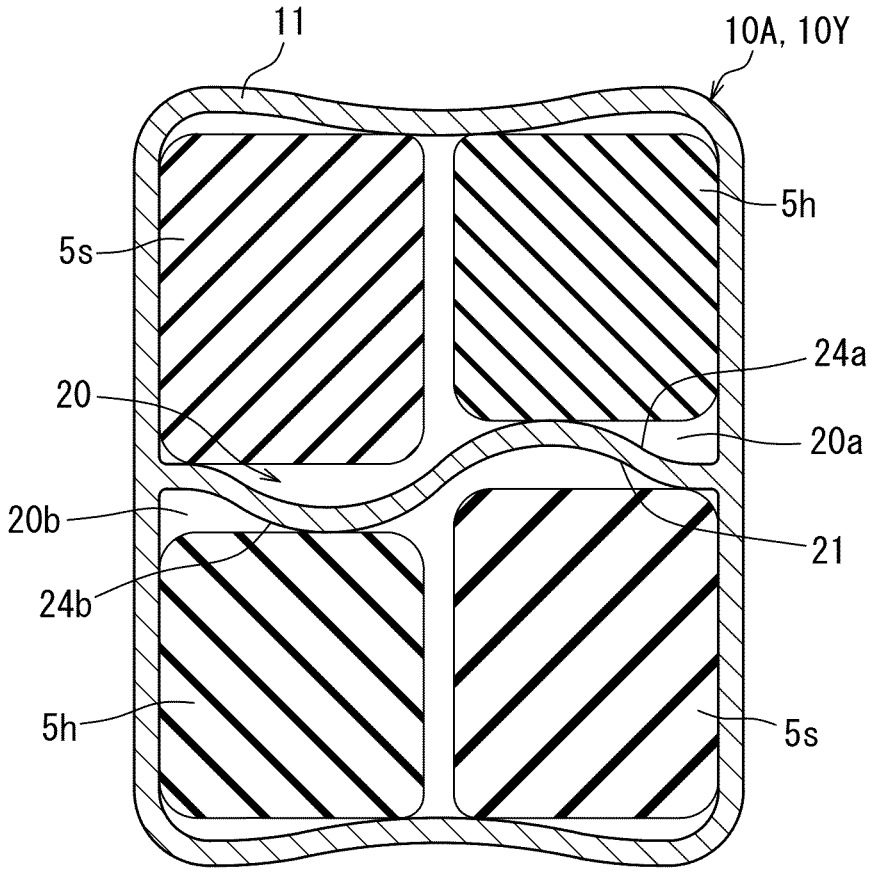
FIG. 8 is a view corresponding to FIG. 2 of the extruded material according to a second embodiment of the present invention.

Next, the extruded material 10 or the method for producing the extruded material according to a second embodiment will be described with reference to FIG. 8, focusing on differences from the above embodiment.

The original shape of the extruded material 10A before the correction is the same as that of the first embodiment. In the present embodiment, at the time of the correction processing, instead of the single rubber 5 (see FIG. 7), two types of rubbers 5*h* and 5*s*, that is, a soft rubber 5*s* and a hard rubber 5*h* having a hardness higher than that of the soft rubber 5*s* are arranged in both the first chamber 20*a* and the second chamber 20*b*. The hard rubber 5*h* and the soft rubber 5*s* are arranged side by side in the short side direction. As described above, the middle rib 21 has the first protrusion 24*a* protruding to the first chamber 20*a* on one side in the short side direction (right side in the plane of drawing of FIG. 8) and the second protrusion 24*b* protruding to the second chamber 20*b* on the other side in the short side direction (left side in the plane of drawing of FIG. 8). In the first chamber 20*a*, the hard rubber 5*h* is disposed on one side, and is in contact with a top of the first protrusion 24*a* protruding to the first chamber 20*a*. In the second chamber 20*b*, the hard rubber 5*h* is disposed on the other side, and is in contact with a top of the second protrusion 24*b* protruding to the second chamber 20*b*. Two soft rubbers 5*s* are arranged on a side opposite to the hard rubber in the short side direction in each of the first chamber 20*a* and the second chamber 20*b*.

The hard rubber 5*h* and the soft rubber 5*s* are compressed all together in the longitudinal direction by the pusher 8 (see FIGS. 5 and 7) in the same manner as in the first embodiment. The hard rubber 5*h* is larger than the soft rubber 5*s* in a pressing force generated by bulging accompanying compressive deformation. Therefore, curvature of the first protrusion 24*a* and the second protrusion 24*b* is easily eliminated, and deformation of the extruded material 10A is smoothly performed.

Third Embodiment

Figure 9:
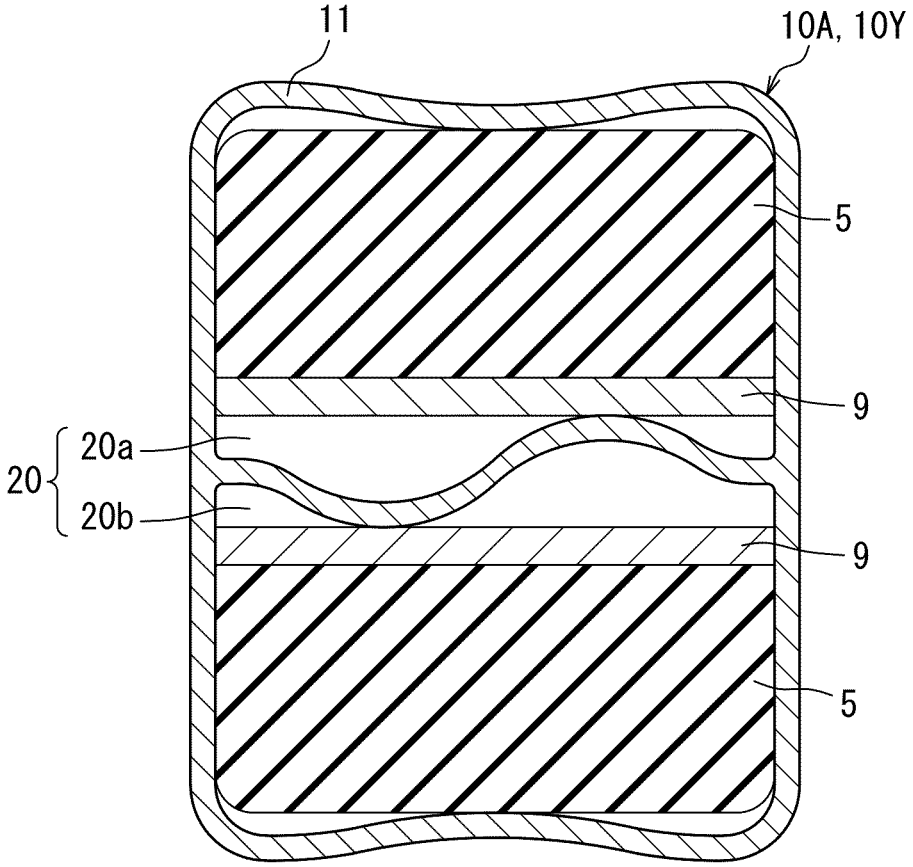
FIG. 9 is a view corresponding to FIG. 2 of the extruded material according to a third embodiment of the present invention.

Next, the extruded material 10 or the method for producing the extruded material according to a third embodiment will be described with reference to FIG. 9, focusing on the differences from the above embodiments.

The original shape of the extruded material 10A before the correction is the same as that of the first embodiment. In the present embodiment, rib pressers 9 are respectively attached to side surfaces of rubbers 5 at the time of the correction processing. The rib presser 9 has higher hardness than that of the rubber 5. A material of the rib presser 9 is not limited to rubber, and may be a resin material or a metal material such as an aluminum alloy. Each rib presser 9 is disposed in a corresponding one of the first chamber 20*a* and the second chamber 20*b* together with the corresponding rubber 5 so as to be close to and face the middle rib 21. When the rubber 5 is compressed, the bulging of the rubber 5 causes the rib presser 9 to press the middle rib 21 in the long side direction. As in the second embodiment, the curvature of the first protrusion 24*a* and the second protrusion 24*b* is easily eliminated, and the deformation of the extruded material 10A is smoothly performed.

Fourth Embodiment

Figure 10:
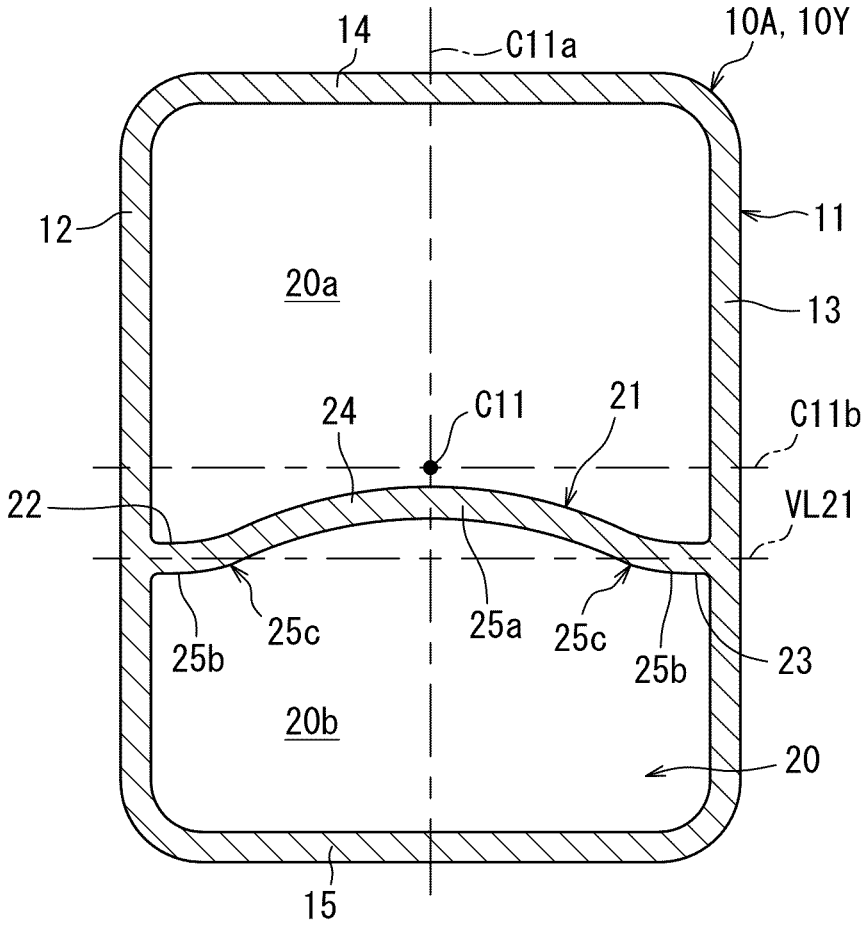
FIG. 10 is a view corresponding to FIG. 2 of the extruded material according to a fourth embodiment of the present invention.

Next, the extruded material 10 or the method for producing the extruded material according to a fourth embodiment will be described with reference to FIG. 10, focusing on the differences from the above embodiments.

In the present embodiment, the middle rib 21 has a single protrusion 24. The protrusion 24 protrudes toward the first chamber 20*a* with respect to the imaginary straight line VL21 and is line-symmetric with respect to the short-side direction center line C11*a* of the peripheral wall 11. The protrusion 24 includes a first arcuate portion 25*a* that curves convexly toward the first chamber 20*a*, and a pair of second arcuate portions 25*b* that is continuous with both end portions of the first arcuate portion 25*a* and curves convexly toward the second chamber 20*b*. A pair of inflection portions 25*c* between the first arcuate portion 25*a* and the pair of second arcuate portions 25*b* are respectively close to the connecting portions 22 and 23. A vertex of the first arcuate portion 25*a* is positioned on the short-side direction center line C11*a*, and vertices of the pair of second arcuate portions 25*b* are respectively positioned at the connecting portions 22 and 23.

The connecting portions 22 and 23 are positioned at positions facing each other in the short-side direction, but are connected on one side in the long-side direction (lower side in the plane of drawing of FIG. 10) with respect to midpoint portions in the long-side direction of the long side walls 12 and 13, unlike the above-described embodiments. Therefore, the imaginary straight line VL21 is offset to one side in the long side direction with respect to the long-side direction center line C11*b*. Thus, the cross-sectional area of the first chamber 20*a* is larger than that of the second chamber 20*b*.

Also in this case, the rubbers 5 are respectively arranged in the first chamber 20*a* and the second chamber 20*b*, and the peripheral wall 11 is expanded outward due to bulging accompanying compression of the rubber 5. This makes it possible to obtain the same operational effects as those of the first embodiment.

Fifth Embodiment

Figure 11:
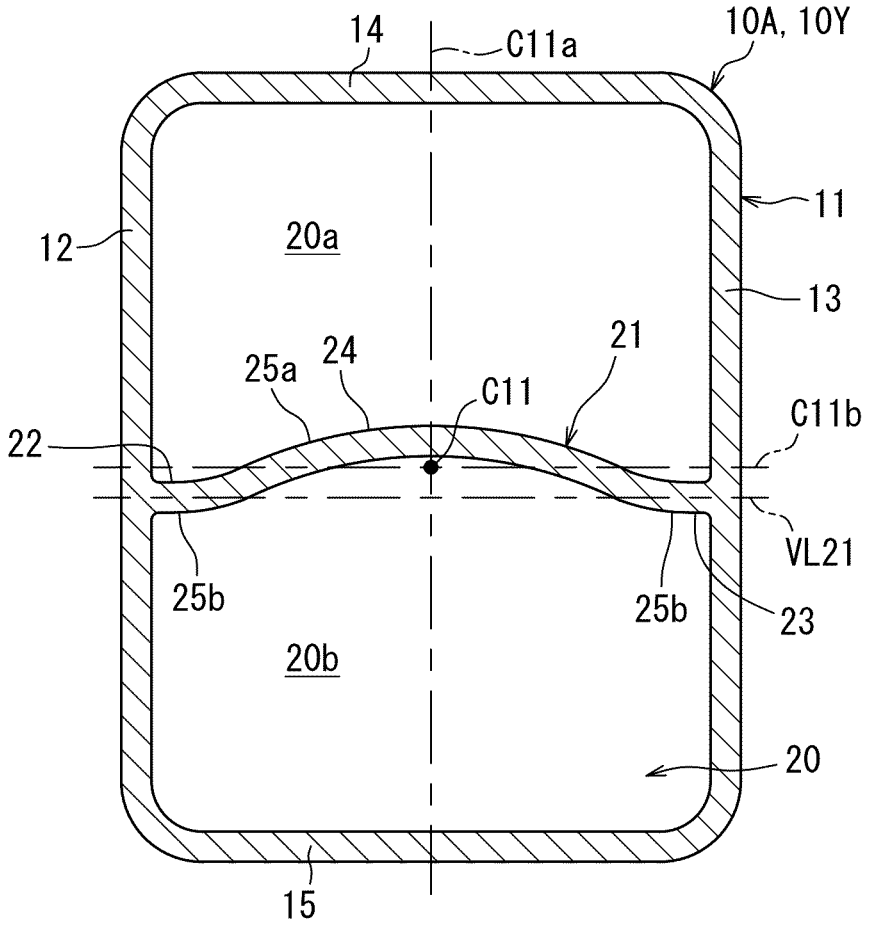
FIG. 11 is a view corresponding to FIG. 2 of the extruded material according to a fifth embodiment of the present invention.

Next, the extruded material 10 or the method for producing the extruded material according to a fifth embodiment will be described with reference to FIG. 11, focusing on the differences from the above embodiments.

In the present embodiment, the shape itself of the middle rib 21 is similar to that of the fourth embodiment, but the positions of the connecting portions 22 and 23 in the longitudinal direction are brought close to the long-side direction center line C11*b*, so that the cross-sectional area of the first chamber 20*a* is equal to that of the second chamber 20*b*.

Also in this case, the rubbers 5 are respectively arranged in the first chamber and the second chamber 20*b*, and the peripheral wall 11 is expanded outward due to bulging accompanying compression of the rubber 5. This makes it possible to obtain the same operational effects as those of the first embodiment.

Sixth Embodiment

Figure 12:
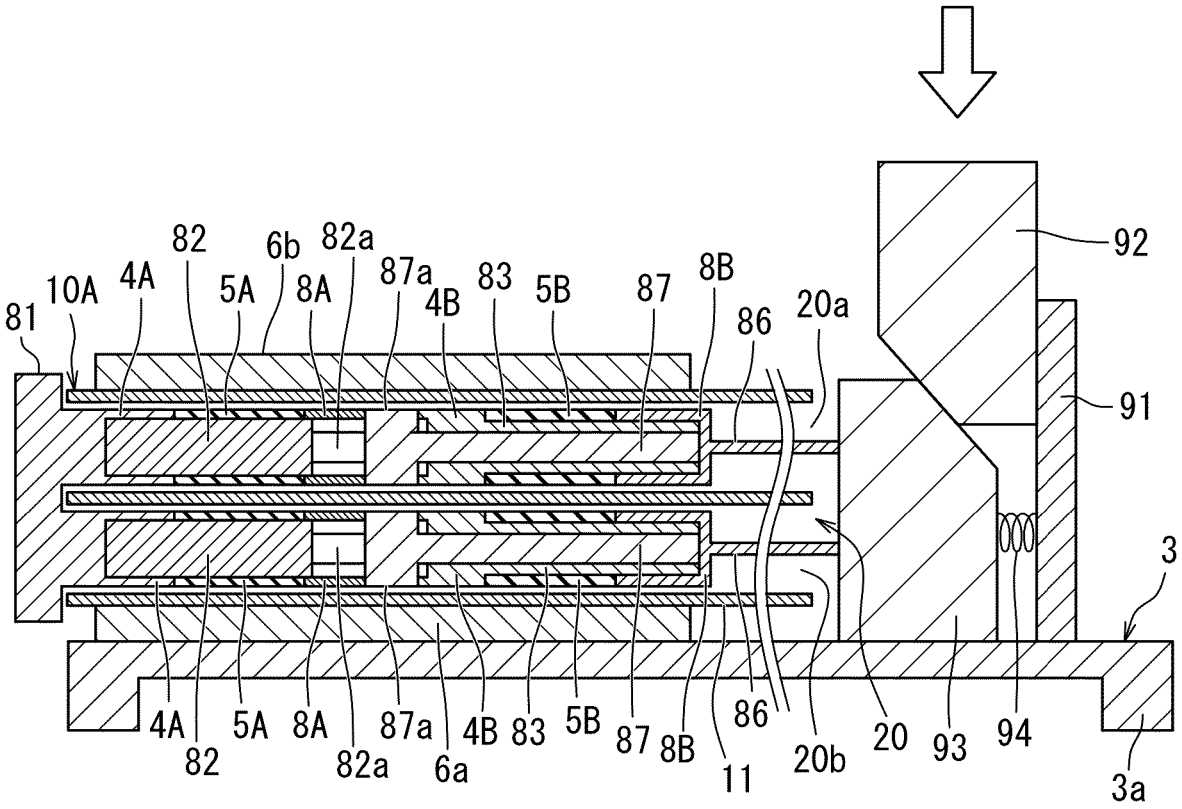
FIG. 12 is an explanatory view of the method for producing the extruded material according to a sixth embodiment of the present invention.

Next, the extruded material 10 or the method for producing the extruded material according to a sixth embodiment will be described with reference to FIG. 12, focusing on the differences from the above embodiments.

In the above embodiments, the correction processing is performed on one predetermined portion by the displacement of the pusher 8. As in the present embodiment, the correction processing may be performed all together on the predetermined portions at multiple locations separated in the longitudinal direction by a single pressing operation.

As an example, molds 6*a* and 6*b* having an upper and lower halved structure are supported on the base 3*a*. The extruded material 10A is supported by the lower mold 6*a* and received in the molds 6*a* and 6*b*. A support wall 91 is erected on the base 3*a*. A single elevator 92 is provided to be guided by the support wall 91 and vertically movable, and a horizontal core 93 in contact with the elevator 92 via an inclined surface is provided to be horizontally movable on the base 3*a*. The horizontal core 93 is connected to the support wall 91 via a tension spring 94.

Also in the present example, rubbers 5A and 5B in the number corresponding to the number of predetermined portions to be subjected to the correction processing are arranged inside each of the first chamber 20*a* and the second chamber 20*b*. The rubbers 5A and 5B are sandwiched between the corresponding cores 4A and 4B and the corresponding pushers 8A and 8B in the longitudinal direction of the extruded material 10A. When the single elevator moves downward, the cores 4A and 4B are fixed with respect to the base 3*a* and thus are immovable, whereas the pushers 8A and 8B move synchronously. Thus, the rubbers 5A and 5B are compressed, and the peripheral wall 11 is expanded outward all together at the plurality of predetermined portions.

In order to realize such an operation, a device for performing the correction processing includes a base 81, a first stator 82, and a second stator 83 as members fixed to the base 3*a* together with the cores 4A and 4B. On the other hand, the device includes a movable shaft 86 and a transmission member 87 as members for moving the pushers 8A and 8B in synchronization when the elevator 92 moves up and down and the horizontal core 93 moves horizontally.

The base 81 is provided to be immovable relative to the base 3*a* of the jig 3. Means for installing the base 81 is not particularly limited. The base 81 is disposed outside the mold, and has a facing surface facing one end opening of the extruded material 10A in the longitudinal direction in a state where the extruded material 10A is received in the mold. For the core 4A disposed in the first chamber 20*a* and the core 4B disposed in the second chamber 20*b*, two cores 4A and 4B are provided on the facing surface of the base 81, one core 4A is inserted into the first chamber 20*a* through the one end opening, and the other core 4A is inserted into the second chamber 20*b* through the one end opening.

The first stator 82 is formed in a shaft shape, has one end portion fixed to a tip portion of the core 4A, and extends in the longitudinal direction in the hollow 20. The second stator 83 is also formed in a shaft shape as a whole. One end portion of the second stator 83 is fixed to the other end portion of the first stator 82. The core 4B is integrally provided at the one end portion of the second stator 83 and has a larger diameter than a shaft diameter of the second stator 83.

Means for fixing these members to each other is not particularly limited. As an example, one end portion of the first stator 82 is fitted into a recess formed in a tip surface of the core 4A. The other end portion of the first stator 82 is fitted into a recess formed in an end surface of the one end portion (that is, the core 4B) of the second stator 83.

On the other hand, two movable shafts 86 extend in the longitudinal direction from the horizontal core 93, and are respectively inserted into the first chamber 20*a* and the second chamber 20*b* through the other end opening of the extruded material 10A. The pusher 8B is provided at a tip portion of the movable shaft 86 and has a diameter larger than a shaft diameter of the movable shaft 86.

The transmission member 87 is formed in a shaft shape, and a base end portion thereof contacts a bottom surface of a recess formed on an end surface of the pusher 8B. The second stator 83 is formed in a cylindrical shape, and the transmission member 87 is inserted into the second stator. A flange 87*a* is formed at a distal end portion of the transmission member 87, and the flange 87*a* protrudes radially from the inside to the outside of the second stator 83 via a groove formed at the other end portion of the first stator 82. The pusher 8A is externally fitted to the first stator 82 in the radial direction. An end surface of the pusher 8A contacts a flange 87*a*.

An annular space is formed on the outer peripheral side of the first stator 82 and between the core 4A and the pusher 8A in the longitudinal direction when viewed in the longitudinal direction. The rubber 5A is disposed in this space. Further, an annular space is formed on the outer peripheral side of the second stator 83 and between the core 4B and the pusher 8B in the longitudinal direction when viewed in the longitudinal direction. The rubber 5B is disposed in this space. The above configuration is accommodated in both the first chamber and the second chamber.

When the elevator moves downward, the horizontal core moves horizontally with respect to the base 3*a* so as to approach the other end opening of the extruded material 10A by a wedge action. Thus, the movable shaft 86 enters the hollow 20, and the pusher 8A integrally moves toward the core 4A in the longitudinal direction. When the pusher 8A moves, the transmission member in contact with the pusher also moves integrally in the longitudinal direction. Thus, the pusher 8B provided on the transmission member also moves integrally. Note that since a groove 82*a* formed in a tip portion of the first stator 82 extends in the axial direction (the longitudinal direction of the extruded material 10A), movement of the transmission member having the flange is not hindered by the first stator, but rather, slide in the longitudinal direction is guided by the groove.

As described above, while the pushers 8A and 8B move synchronously by downward movement of the elevator, the base 81, the first stator 82, and the second stator 83 do not move relative to the base 3*a* of the jig 3 and guide movement of the movable shaft 86 and the transmission member 87. Therefore, the rubber 5A is sandwiched and compressed between the pusher 8A and the core 4A, and the rubber 5B is sandwiched and compressed between the pusher 8B and the core 4B. As described above, since the correction processing is performed all together at the plurality of predetermined portions by one pressing operation, the production time of the extruded material 10 can be shortened. In addition, accuracy of a relative positional relationship between the plurality of corrected portions 10X is improved.

Although the embodiment of the present invention has been described so far, the above configuration and method can be appropriately changed, added, and deleted within the scope of the gist of the present invention.

The number of middle ribs 21 may be plural. A tube expansion forming method other than the rubber bulge forming may be applied to the correction processing. The extruded material 10 (10B) may be applied to vehicle parts other than the vehicle frame, or may be applied to structural parts other than vehicle components.

What is claimed is:

1. A method for producing an extruded material, comprising:

extruding a metal material to obtain an extruded material; and performing correction of the extruded material, wherein the extruded material includes a peripheral wall having a closed loop-shaped cross-section and defining a hollow, and a middle rib connected to an inner peripheral surface of the peripheral wall and dividing the hollow, in an original shape of the extruded material before the correction, the middle rib has a cross-section curved with respect to an imaginary straight line connecting connecting portions connected with the peripheral wall, and the correction includes:

disposing a mold so as to face an outer peripheral surface of the peripheral wall at a predetermined portion in a longitudinal direction of the extruded material; and expanding the peripheral wall outward at the predetermined portion, pressing the outer peripheral surface of the peripheral wall against an inner surface of the mold while reducing a degree of curvature of the middle rib with respect to the original shape, and transferring an inner surface shape of the mold to the outer surface of the peripheral wall.

2. The method for producing the extruded material according to claim 1, wherein expanding the peripheral wall outward includes:

disposing rubber at the predetermined portion in the hollow; and compressing the rubber in the longitudinal direction to bulge the rubber in a direction intersecting the longitudinal direction, and expanding the peripheral wall outward by the bulged rubber.

3. The method for producing the extruded material according to claim 2, wherein when the rubber is disposed, a core is disposed adjacent to the rubber in the longitudinal direction in the hollow, and when the rubber is compressed, the rubber is pressed by a pusher from a side opposite to the core, and is compressed by the pusher and the core.

4. The method for producing the extruded material according to claim 3, wherein a plurality of the predetermined portions are set apart from each other in the longitudinal direction, when the rubber is disposed, a plurality of sets of the rubbers and cores are respectively arranged at the plurality of predetermined portions, and when the rubber is compressed, the plurality of sets of the rubbers are compressed all together by a pressing force of the single pusher.

5. The method for producing the extruded material according to claim 1, wherein the cross-section of the peripheral wall is rectangular, and the peripheral wall has a pair of long side walls forming long sides of the rectangular cross-section and a pair of short side walls forming short sides of the rectangular cross-section, and the single middle rib connects inner surfaces of the pair of long side walls and divides the hollow into a first chamber and a second chamber extending in the longitudinal direction.

6. The method for producing the extruded material according to claim 5, wherein in the original shape before the correction, the middle rib has two protrusions of a first protrusion protruding to the first chamber and a second protrusion protruding to the second chamber with respect to the imaginary straight line.

7. The method for producing the extruded material according to claim 5, wherein in the original shape before the correction, the middle rib has a single protrusion protruding to the first chamber with respect to the imaginary straight line, and the first chamber has a cross-sectional area larger than that of the second chamber.

8. An extruded material comprising:

a peripheral wall having a closed loop-shaped cross-section and defining a hollow;

a middle rib connected to an inner peripheral surface of the peripheral wall and dividing the hollow;

a corrected portion set at a predetermined portion in a longitudinal direction and subjected to correction processing; and an uncorrected portion not subjected to the correction processing, wherein the peripheral wall is expanded outward with respect to an original shape of the uncorrected portion in the corrected portion, and the middle rib is curved with respect to an imaginary straight line connecting connecting portions connected with the peripheral wall at both end portions of the middle rib in the uncorrected portion, and has a smaller degree of curvature than the original shape of the uncorrected portion in the corrected portion.

* * * * *